United States Patent [19]

Walitalo

[11] 4,106,733

[45] Aug. 15, 1978

[54] BAG DISPENSER AND HOLDER

[75] Inventor: Charles Richard Walitalo, Matteson, Ill.

[73] Assignee: Union Carbide Corporation, New York, N.Y.

[21] Appl. No.: 782,390

[22] Filed: Mar. 29, 1977

[51] Int. Cl.[2] ..... B65B 67/04

[52] U.S. Cl. ..... 248/100; 53/189; 53/390; 211/59.1; 221/312 A; 248/222.2

[58] Field of Search ..... 248/99, 95, 100, 222.1, 248/222.2, 223.3, 225.1, 225.2, 311.1, 312; 211/57.1, 59.1, 54.1; 53/384, 390, 189; 221/310, 312 A; 15/257.1; 206/526, 801

[56] References Cited

U.S. PATENT DOCUMENTS

| | | | |
|---|---|---|---|
| 413,520 | 10/1889 | Julian | 248/222.2 X |
| 546,706 | 9/1895 | McConnell | 248/311.1 X |
| 575,403 | 1/1897 | Morton | 248/100 |
| 810,329 | 11/1906 | Dyett | 248/99 |
| 939,508 | 11/1909 | Hull | 248/100 |
| 991,245 | 5/1911 | Rhoades | 211/54.1 |
| 1,203,942 | 11/1916 | Walker | 248/311.1 |
| 1,351,094 | 8/1920 | Buckel | 248/100 |
| 1,653,393 | 12/1927 | Cox | 248/99 |
| 1,760,752 | 5/1930 | Happer | 248/99 |
| 1,809,317 | 6/1931 | Snyder | 248/101 X |
| 1,895,904 | 1/1933 | Lutts et al. | 248/99 |
| 2,057,836 | 10/1936 | Leonardson | 248/99 |
| 2,903,215 | 9/1959 | Metcalf | 248/99 |
| 2,927,715 | 3/1960 | Lux | 221/108 |
| 3,008,569 | 11/1961 | Murch | 206/19.5 |
| 3,439,891 | 4/1969 | Pinto | 248/100 |
| 3,454,166 | 7/1969 | Dinges | 206/526 X |
| 3,455,529 | 7/1969 | Propst et al. | 248/100 |
| 3,646,723 | 3/1972 | Meroney | 53/384 X |
| 3,653,619 | 4/1972 | Plum | 248/99 |
| 3,738,482 | 6/1973 | Cwikla | 248/100 X |
| 3,770,134 | 11/1973 | Kupcikevicius | 211/57 |
| 3,777,930 | 12/1973 | Ericson et al. | 221/26 |
| 3,861,125 | 1/1975 | Hagemeister | 53/390 |

FOREIGN PATENT DOCUMENTS

| | | | |
|---|---|---|---|
| 270,432 | 4/1964 | Australia | 248/100 |
| 102,502 | 8/1965 | Denmark | 248/100 |
| 2,002,732 | 8/1970 | Fed. Rep. of Germany | 248/100 |

OTHER PUBLICATIONS

"The Star Patent Bag Holder", American Miller, Apr. 1, 1888, p. 253.

*Primary Examiner*—Rodney H. Bonck
*Attorney, Agent, or Firm*—Cornelius F. O'Brien

[57] ABSTRACT

A bag dispenser and holder comprising a brace member having distending from its ends a pair of spaced-apart wicket and support members from which outwardly and oppositely opposed deformable curved members extend to define a substantial hoop-type configuration and having at least one U-shaped hook-wicket distending intermediate said support members. The pair of support members and hook-wicket cooperate to support and maintain a bag having wicket holes in the open position.

14 Claims, 27 Drawing Figures

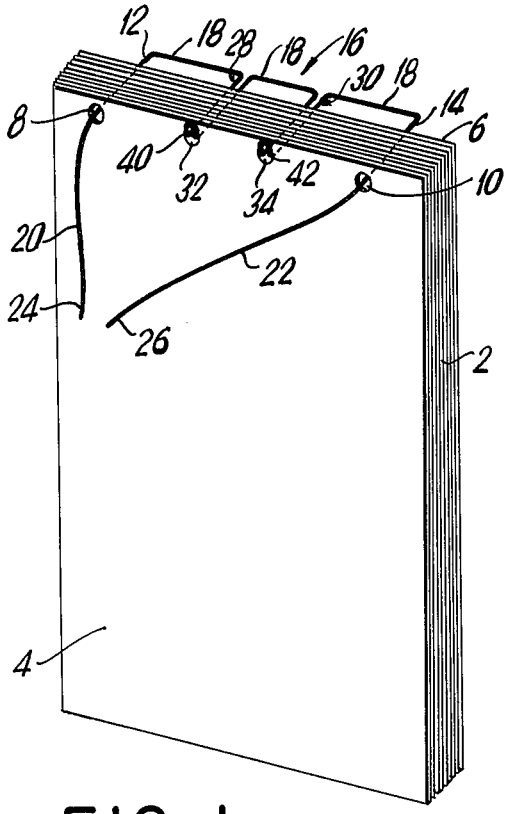
FIG. 1
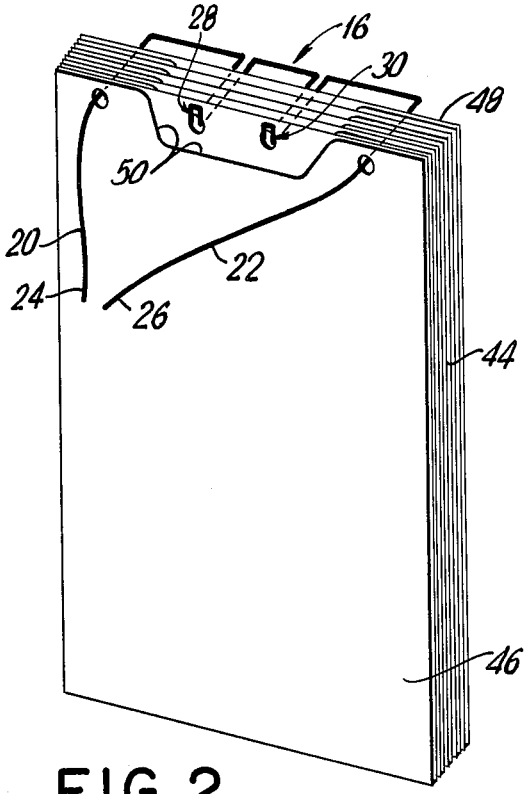
FIG. 2
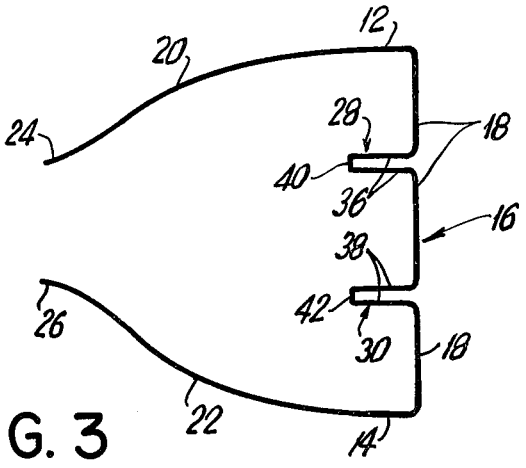
FIG. 3
FIG. 5
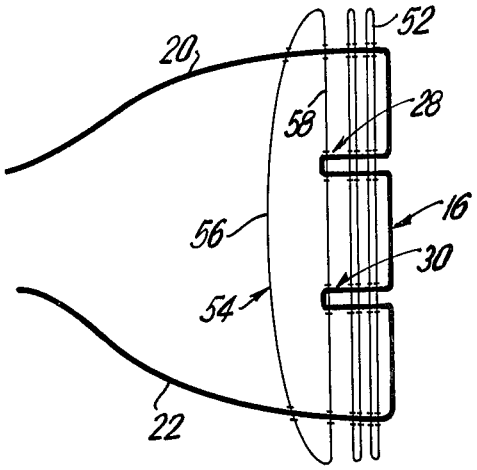
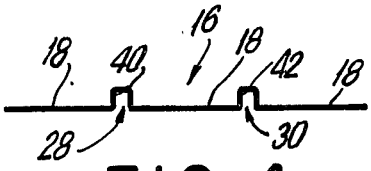
FIG. 4

FIG. 6
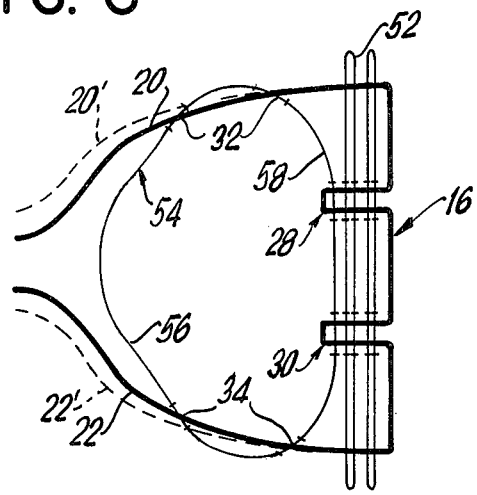
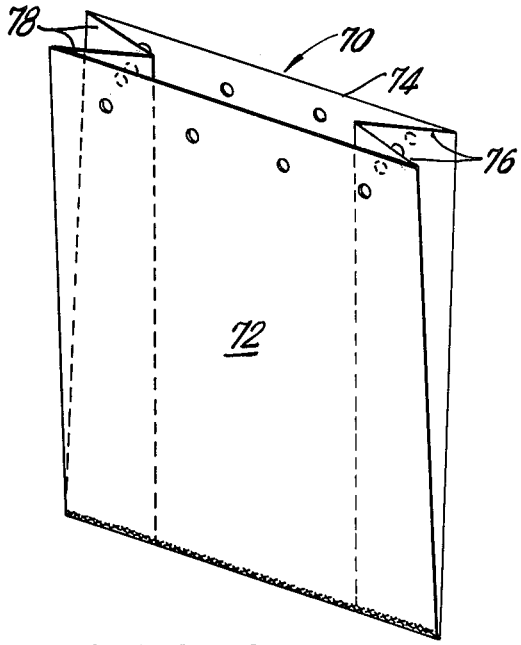
FIG. 9
FIG. 7
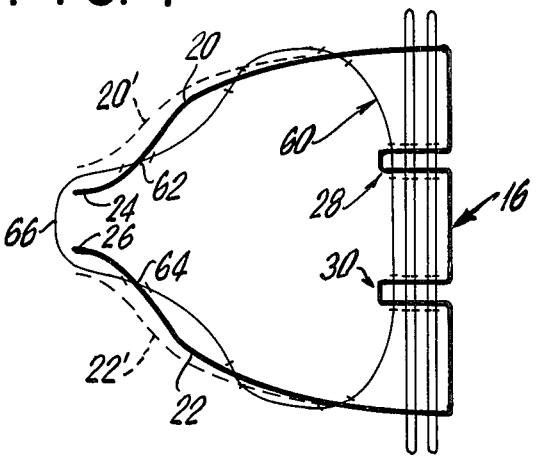
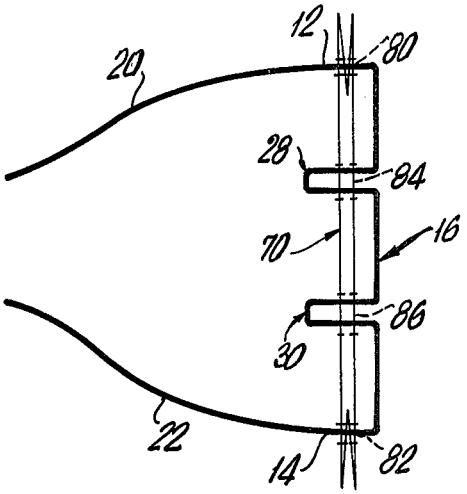
FIG. 10
FIG. 8
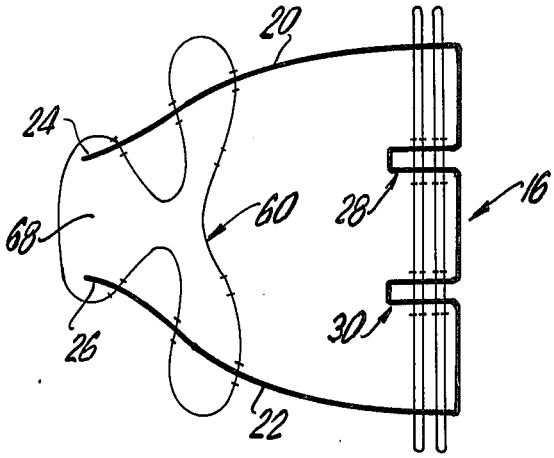

FIG. 11
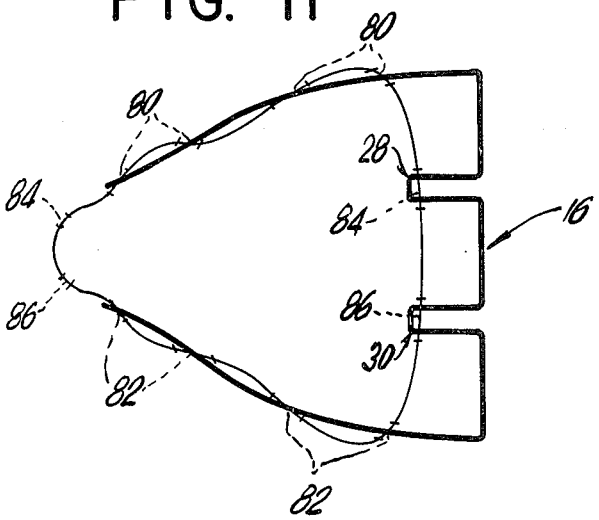
FIG. 17
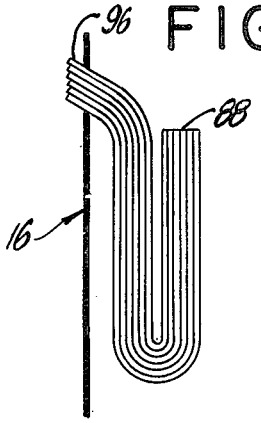
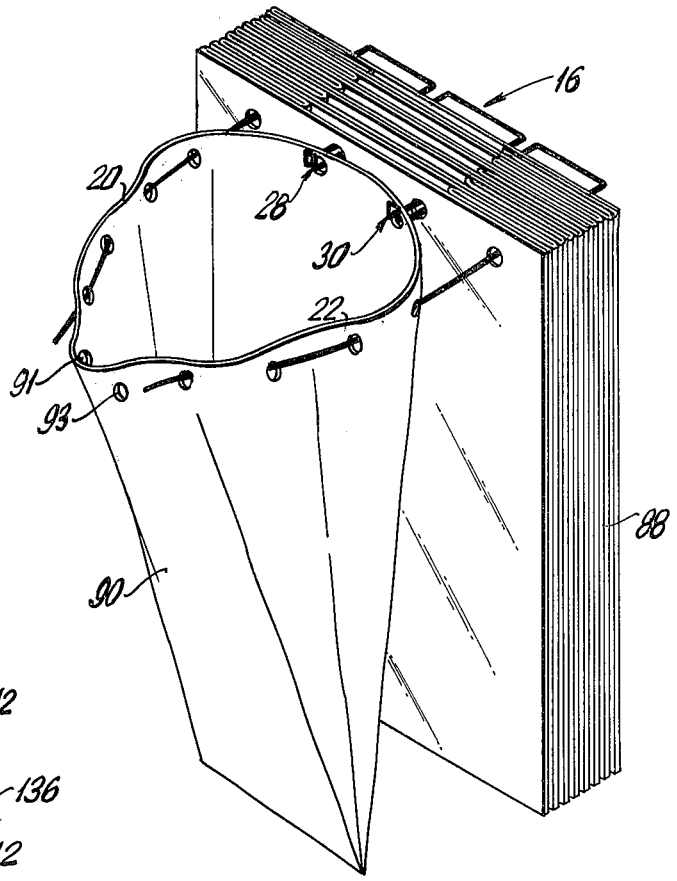
FIG. 12
FIG. 16
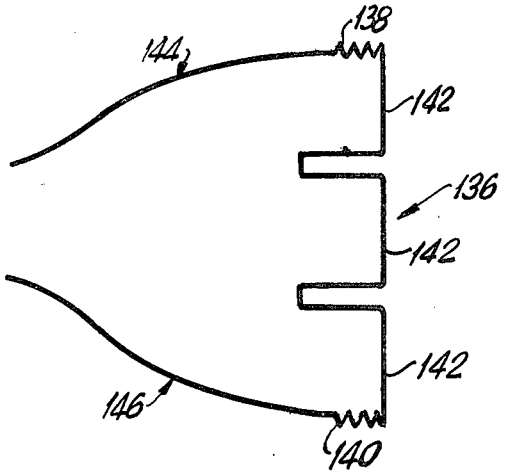

BAG DISPENSER AND HOLDER

FIELD OF THE INVENTION

The invention relates to a bag dispenser and holder for supporting a plurality of stacked bags which are to be dispensed or removed from the stack one at a time and having a brace member with distending oppositely opposed spaced-apart curved members forming a hoop-type configuration and intermediate said curve members distending U-shaped hook-wickets which cooperate with said curve members for supporting the dispensed bag in an open position for utilization.

BACKGROUND OF THE INVENTION

Packaging operations in industry are of significant import with interest towards promoting the rapid, efficient and economical packaging of products for the market. In commercial applications, such as the packaging of groceries or household articles or trash, it is highly desirable to have means whereby a bag can be easily dispensed from a carton and held in an open position for receiving various types of contents. Although many bag dispensers are available from which bags can be dispensed one at a time, the bags, either made of paper base material of flexible plastic film material, are usually strong enough to contain various size and weight articles, but are not strong enough or have sufficient integrity to retain an upright open position during the packaging operation without some additional support or retaining means.

U.S. Pat. Nos. 810,329, 939,508, 1,653,393, 1,760,752, 1,895,904, 2,903,215 and 3,653,619 all disclose various support or retaining means for maintaining a bag in an open position to receive various articles. These references generally either disclose embodiments whereby a bag is first dispensed from a supply carton or station and unfolded, opened and then tucked or taped into a clip type means, or fed onto wickets through holes in the upper portion of the bags. Another embodiment (U.S. Pat. No. 810,329) discloses a bag holder having means for maintaining a bag in an open position while also having means for accommodating reserve bags. This reference, however, employs pressure type clip means for maintaining a bag in an open position and thus would require an operator to manipulate the top edge portion of a bag through several clip means before the bag is in an open position to receive articles.

In addition to the awkwardness of positioning an opened bag on known retaining or supporting means, the removal of the bag after its desired contents are fed therein has proven to be just as cumbersome and time consuming.

An approach to eliminate the use of retaining or supporting means to maintain a bag in an open position is to increase the rigidity of the bag by using a material which has sufficient integrity to enable the bag to retain an upright open position without support means. This approach, however, would require a great increase in material cost thus making it an impractical commercial alternative.

Filed concurrently herewith by applicant and incorporated herein by reference is United States Patent Application Ser. No. 782, 387 titled A BAG DISPENSER AND HOLDER disclosing a bag dispenser and support holder which comprises a brace member having a pair of outwardly distending spaced-apart, preferably substantially parallel, support members for supporting a plurality of flat or gusset bags through wicket holes in said bags; a first deformable, resilient, substantially arcuate member depending from the end of one of said spaced-apart support members; a second deformable, resilient arcuate member depending from the end of the other of said spaced-apart support members; and said deformable, resilient substantially arcuate members being outwardly and oppositely aligned in a common plane to define a substantial hoop configuration adapted to be intertwined with the mouth of the bag through bag wicket holes for supporting and maintaining the bag in an open position.

It is an object of the present invention to provide a bag dispenser and support holder that will permit bags to be dispensed one at a time and sequentially held in an open position for receiving various size articles.

It is another object of the present invention to provide a bag dispenser and holder that is designed to facilitate the opening of a bag as it is fed from a supply station, to maintain the bag in an open position, and then once the bag has received its desired contents, it is also designed to facilitate the closing of the bag.

Another object of this invention is to provide a bag dispenser and holder that is adapted to accommodate a plurality of reserve bags; adapted to facilitate the opening of a bag as it is fed from the reserve; adapted to maintain the opened bag in an upright position; and adapted to facilitate the closing of the bag once it is filled with a desired size and quantity of articles.

Another object of this invention is to provide a bag dispenser and holder that is easy to fabricate and easy to use.

Another object of the present invention is to provide a bag dispenser and holder that is designed to maintain a bag in an open position and adapted such that the bag can be closed after partial filling and then reopened to complete the filling of the bag thereby maintaining sanitary conditions during an interrupted filling operation.

The foregoing and additional objects will become more fully apparent from the following description and the accompanying drawing.

SUMMARY OF THE INVENTION

The invention relates to a bag dispenser and support holder comprising a brace member having a pair of deformable, preferably resilient, outwardly distending, spaced-apart support members, said support members comprising substantially straight inner segments for supporting a plurality of bags proximal the brace member through a pair of spaced-apart holes in the bags, and curved, inwardly opposed outer segments which are aligned in a common plane to define a substantial, open hoop-type configuration; said brace member having at least one outwardly distending hook-wicket intermediate said distending pair of support members adapted for further supporting the plurality of bags through holes in said bags intermediate the pair of spaced-apart holes; and said outer segments of the support members and said at least one hook-wicket being adapted for supporting and maintaining a bag in an open position through holes in the bag.

Preferably, the spaced-apart straight segments of the support members should be parallel so as to support a plurality of compacted bags in a plane normal thereto. The outer free extremities of the curved segments should preferably be substantially parallel so as to facilitate the loading and removal of bags onto and off of, respectively, the bag dispenser and support holder.

Preferably there should be at least two hook-wickets distending from the brace member so as to facilitate and insure the bag mouth being fully opened and adequately supported for utilization.

As used herein, a deformable, resilient member shall mean a member with or without cooperating spring means, that is capable of being deformed under pressure, return substantially to its original shape upon release of the pressure, and have sufficient resiliency to exert a pressure on a surface opposing the return of the member to its substantially original shape.

As used herein, a curved member shall mean a member having a bow-like configuration made from one continuous curve, two or more curves, two or more straight segments arranged to provide an overall bow-like or arc-like configuration, or a combination of one or more curves and one or more straight segments arranged to provide an overall bow-like or arc-like configuration. The essential feature of the curved member is that when it is oppositely aligned in a common plane with a second curved member, they will define a substantial, open hoop-type configuration which can be utilized to assist in maintaining the open end of a bag in a fully open position through holes in the bag.

As used herein, a hook-wicket shall mean any hook configuration having an inner opened perimeter sustaining more than one plane, such as U-shaped, V-shaped, semi-circular-shaped, L-shaped or the like members which can support and hold bags through appropriate bag wicket holes.

The bag dispenser and holder can be made of a variety of materials, such as aluminum, steel, copper, plastics or various substrates coated with various types of coating materials which should be compatible with the material of the bags to be dispensed and have an elasticity sufficient to accommodate the bag dimensional design. The bag dispenser and holder could also be fabricated from a combination of the above materials or other type materials, or from rigid-type materials in conjunction with spring means as will be discussed below.

The bag should be made of a material having sufficient strength and the support wicket holes should be suitably disposed so that as a bag is pulled from the substantially straight segments onto the curved segments of the support members, the bag will apply a sufficient inward force on the curved segments to slightly collapse the curved segments so as to accommodate the spacing of the support wicket holes in the bag as the bag advances on the curved segments. Once the bag is fully advanced on the curved segments, the curved segments will exert an outwardly applied tensive force on the mouth of the bag sufficient to maintain the mouth of the bag in an open position. If desired, the bags for use on the dispenser and holder of this invention could be made with a cuffed mouth portion, that is, a two or more ply bag mouth portion, through which the wicket holes could be disposed. This will impart additional strength to the bag areas defining the wicket holes and thus enable the advancing bag to more effectively collapse the curved segments as discussed above.

BRIEF DESCRIPTION OF THE DRAWING

FIG. 1 is an isometric view of a stack of flat bags assembled on a bag dispenser and holder in accordance with this invention.

FIG. 2 is an isometric view of a stack of gusset bags assembled on a bag dispenser and holder of this invention.

FIG. 3 is a plan schematic view of a bag dispenser and holder in accordance with this invention.

FIG. 4 is a rear schematic view of the bag dispenser and holder of FIG. 3.

FIG. 5 is a plan schematic view of bags assembled on the bag dispenser and holder of FIG. 3 showing the initial bag being dispensed and advanced on the bag dispenser and holder.

FIG. 6 is a plan schematic view of FIG. 5 showing the initial dispensed bag in a fully opened position.

FIG. 7 is a plan schematic view of the bag dispenser and holder of FIG. 3 showing a bag of the type illustrated in FIG. 1 in a fully opened position.

FIG. 8 is a plan schematic view of the bag dispenser and holder of FIG. 7 showing the initial dispensed bag being advanced to a closing position.

FIG. 9 is an isometric view of a partially opened gusset bag for use on a bag dispenser and holder as shown in FIG. 3.

FIG. 10 is a plan schematic view of a gusset bag assembled on the bag dispenser and holder of the type shown in FIG. 3.

FIG. 11 is a plan schematic view of FIG. 10 showing the gusset bag in a fully open position.

FIG. 12 is an isometric view of a gusset bag shown in the open position on a dispenser and holder in accordance with this invention.

FIG. 16 is a plan schematic view of a bag dispenser and holder employing rigid-type support members depending from spring means connected to the brace member of a bag dispenser and holder in accordance with this invention.

FIG. 17 is a side view of a bag dispenser and holder of FIG. 12 showing a plurality of bags in a folded assembled position.

In general, the present invention comprehends a bag dispenser and holder for a stack of flat or gusset type flexible bags provided with paired holes to accommodate wicket support leg segments and holes intermediate thereof to accommodate hook-wickets and which bags are to be removed one at a time from the stack and held in an open position by the hook-wickets and curved segments extending from the wicket support leg segements. The preferred bags for use in this invention are generally shown in FIGS. 1 and 2 assembled on a bag dispenser and holder in accordance with this invention. Specifically, FIG. 1 shows a stack of flat bags 2 comprising a front ply 4 and back ply 6. Disposed at the upper portion of the bag are paired wicket holes 8 and 10 which pass over and are supported on wicket support leg segments 12 and 14, respectively, of bag dispenser and holder 16 shown also in FIGS. 3 and 4. Bag dispenser and holder 16 comprises a horizontal brace member 18 having depending therefrom wicket support leg segments 12 and 14 which, in turn, terminate in deformable, resilient curved segments 20 and 22, respectively. The extremities 24 and 26 of curved segments 20 and 22 extend outward, preferably substantially parallel to the axis of the aligned holes 8 and 10 in bags 2, so as to facilitate the assembly of a stack of bags onto the bag dispenser and holder 16 and also to facilitate the removal of the bags one at a time from the dispenser and holder 16.

Figure 13:
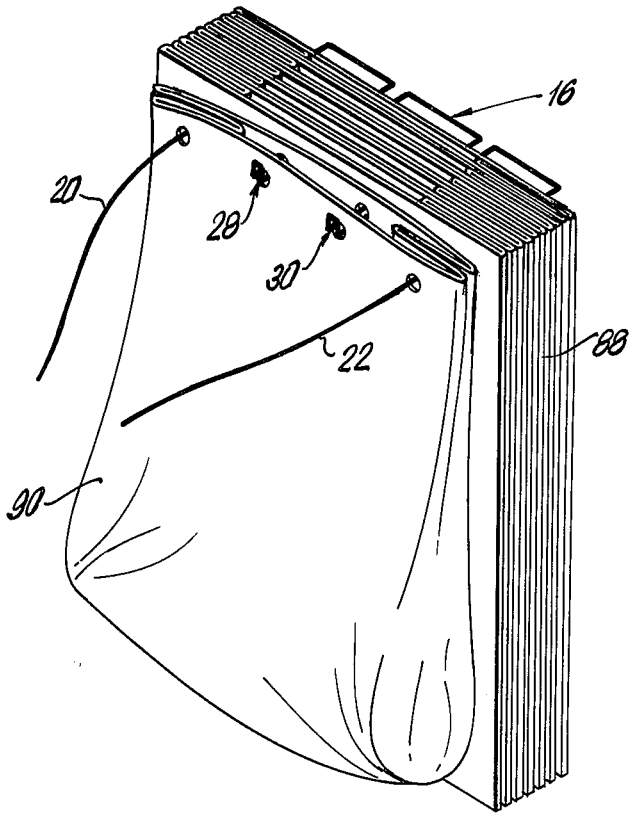
FIG. 13 is an isometric view of a closed partially filled bag on a bag dispenser and holder as shown in FIG. 12.

Distending intermediate from the ends of brace 18 are two spaced-apart, forward extending, hook-wickets 28 and 30 which further support bags 2 through wicket holes 32 and 34 disposed intermediate wicket holes 8 and 10 at the top or mouth portion of bags 2. Each of the hook-wickets 28 and 30 comprises horizontal segments 36 and 38, respectively, distending from brace 18 and terminating in upward vertical extending segments 40 and 42, respectively. Thus horizontal segments 36 and 38 support bags 2 through wicket holes 32 and 34 while vertical segments 40 and 42 prevent bags 2 from sliding off the horizontal segments 36 and 38.

FIG. 2 shows a stack of flat bags 44 which are somewhat similar to the bags 2 shown in FIG. 1 disposed on an identical bag dispenser and holder 16 identified with the same designation numbers. The only difference between bags 2 in FIG. 1 and bags 44 in FIG. 2 is that a portion of the front ply 46 of each bag is lower than the back ply 48 to provide a lip 50 to facilitate opening of each bag 44.

FIGS. 5 through 8 schematically show the steps whereby a bag is first dispensed from a reserve bag supply on a bag dispenser and holder, then opened and retained in the open position for receiving articles, followed by the final step of closing and simultaneously removing the filled bag from the bag dispenser and holder of this invention. Specifically, FIG. 5 schematically shows a stack of flat bags 52 assembled on a bag dispenser and holder 16 of the type shown in FIG. 3 and having the same elements identified with common reference numbers. The initial bag 54 from the bag stack 52 is advanced toward deformable curved segments 20 and 22. As shown in FIG. 6, the initial advancement of bag 54 forces the hoop (20-22) to collapse from its original configuration (20'-22') by a sufficient amount to enable the front ply 56 of bag 54 to be advanced onto the curved segments 20 and 22 while the rear ply 58 is secured on hook-wickets 28 and 30. As the bag is advance onto the curved segments 20 and 22 via holes 32 and 34, the bag forces the curved segments 20 and 22 to be slightly deformed as shown by broken lines 20'-22' in FIGS. 6 and 7.

The bag 54 shown in FIGS. 5 and 6 is of the type illustrated in FIG. 2 in which the front ply 56 has a lip to facilitate opening of the bag. FIG. 6 shows bag 54 in the fully opened position ready to receive articles. FIG. 7 shows a bag 60 of the type shown in FIG. 1 in the fully opened position after the hook-wicket holes 62 and 64 in the front ply 66 of bag 60 have been slid onto the ends 24 and 26 of bag dispenser and holder 16. As evident from FIGS. 6 and 7, the bag types illustrated in FIG. 7 can be retained in a more fully opened position than the bag types illustrated in FIG. 6.

After the bag 60 is packed with the desired size and quantity of articles, the bag is advanced and maneuvered on deformable segments 20 and 22 until it is gathered at the exit end 68 of the hoop-type configuration formed by curved segments 20 and 22 as shown in FIG. 8. As evident from FIGS. 7 and 8, as bag 60 is advancing toward exit end 68 of the hoop, it begins to close such that when it reaches the exit end 68, the bag 60 is fully closed and ready to be sealed, if desired. Although not shown, the extremities 24 and 26 of curved segments 20 and 22, respectively, may be extended to form two closely spaced, substantially parallel legs onto which a filled bag could be advanced. The top edge portion of the bag so advanced on the legs would comprise opposed flat sides forming an envelope-type closure which could be appropriately sealed.

FIG. 9 shows a gusset bag 70 suitable for use on a bag dispenser and holder 16 as shown in FIG. 10. Gusset bag 70 comprises front ply 72, rear ply 74 and gusset sides 76 and 78. As schematically shown in FIG. 10, the bag 70 is supported on bag dispenser and holder 16 by a pair of spaced-apart wicket holes 80 and 82 which are disposed on wicket legs 12 and 14, respectively, and wicket holes 84 and 86 which are disposed on hook-wickets 28 and 30, respectively. Using the technique described in conjunction with FIGS. 5 to 7, bag 70 is advanced to the fully opened position as shown in FIG. 11. As is apparent from FIG. 11, this type of bag can be maintained in the most fully supported position as compared to the bags 54 and 60 illustrated in FIGS. 6 and 7, respectively.

FIG. 12 shows an isometric view of a stack of gusset bags 88 on a bag dispenser and holder 16 with a fully opened bag 90 held and maintained in the open position by a hoop comprising curved segments 20 and 22 and hook-wickets 28 and 30. After bag 90 is partially filled, it can be temporarily closed for sanitary purposes or the like by simply retracting bag 90 back onto curved segments 20 and 22 and replacing the center disposed holes 91 and 93 onto hook-wickets 28 and 30, respectively, as shown in FIG. 13. The latter feature whereby the wicket holes 91 and 93 are replaced onto hook-wickets 28 at 30, respectively, is optional. The retracting of bag 90 can be accomplished by simply reversing the maneuvering procedure shown in FIGS. 5 through 7. Thereafter when bag 90 is to be completely filled, bag 90 is advanced to the fully open position as shown in FIG. 12 using the procedure outlined in conjunction with FIGS. 5 through 7.

Figure 18:
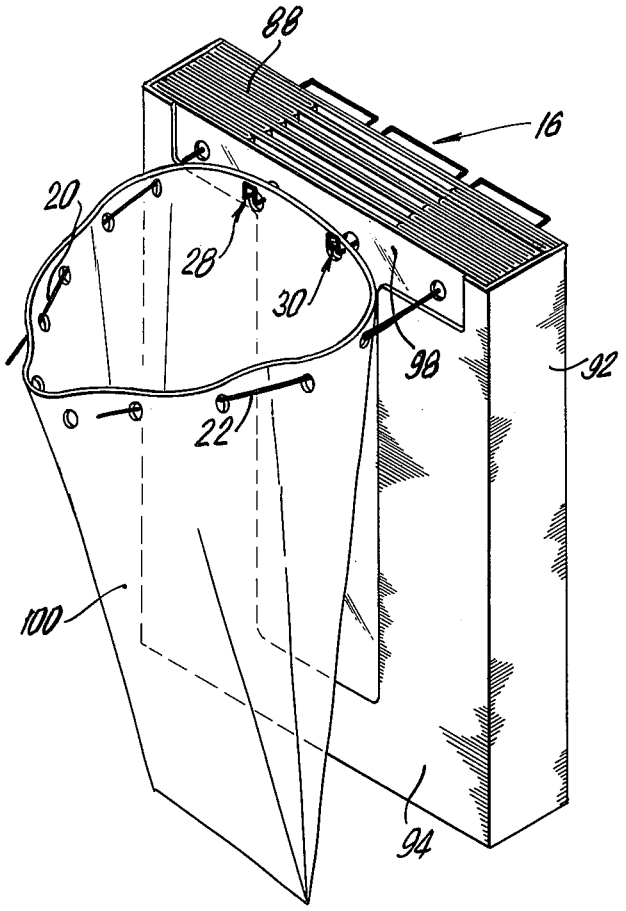
FIG. 18 is an isometric view of an open bag on a dispenser and holder and wherein the reserve bags are assembled in a rectangular carton.

A feature of the bag dispenser and holder 16 containing a stack of separate bags 88 as shown in FIGS. 12 and 13 is that it can be assembled into a relatively small package as shown in FIG. 17. This will enable the dispenser and bags to be assembled into packages that are easy to handle and store thus making them ideal consumer products. The dispenser 16 and bags 88 could also be packed into a carton 92 as shown in FIG. 18. Specifically, the bags 88 would be placed into carton 92 with the dispenser and holder 16 either within carton 92 or disposed parallel to the front wall 94 of the carton 92. In the latter arrangement, the top edges 96 (FIG. 17) would protrude out of the front wall 94 of carton 92 (not shown) through a suitable opening 98. The complete assembly of bags, dispenser and carton could be wrapped with a suitable outer material, such as film or the like. When desired for use, after the outer film is removed, the dispener and holder 16 would be rotated normal to carton 92 and the first bag 100 would be pulled from carton 92 through opening 98. Thus, using the technique described in conjunction with FIGS. 5 through 7, the bag 100 would be advanced to the open position for utilization as shown in FIG. 18. Upon removal of bag 100, the dispenser and holder 16 could be rotated parallel to the front wall 94 of carton 92 and stored until again required.

Figure 19:
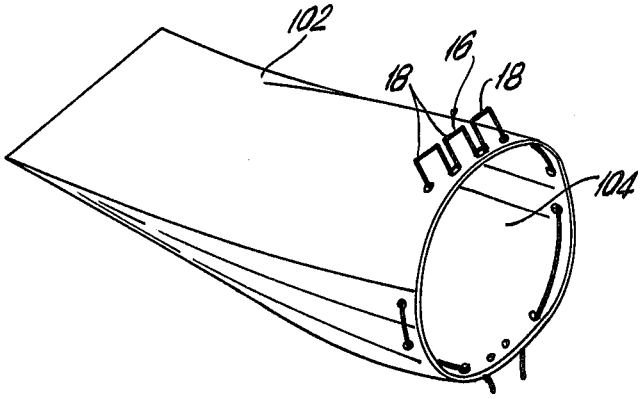
FIG. 19 is an isometric view of another embodiment of an open bag on a bag dispenser and holder in accordance with this invention.

One of the many uses of the bag dispenser and holder of this invention is for collecting leaves or the like. As shown in FIG. 19, a gusset-type bag 102 assembled in the fully open position on a bag dispenser and holder 16 could be manually or otherwise held by the brace member 18 in a manner such that the opening 104 in the bag 102 would be normal to the ground or other support means thus facilitating the sweeping or pushing of leaves or other articles into the bag.

Figure 14:
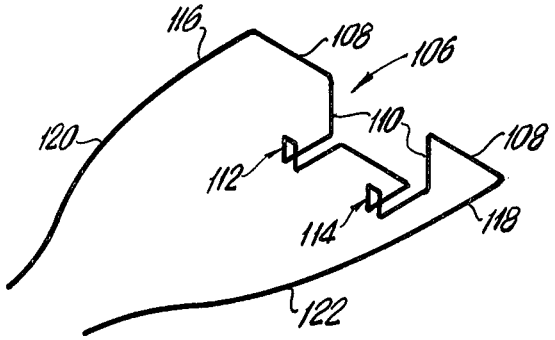
FIG. 14 is a schematic perspective view of another embodiment of a bag dispenser and holder in accordance with this invention.
Figure 15:
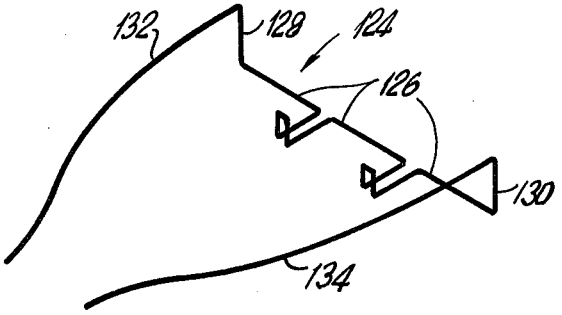
FIG. 15 is a schematic perspective view of another embodiment of a bag dispenser and holder in accordance with this invention.

FIGS. 14 to 16 show alternate embodiments of the bag dispenser and holder of this invention. Specifically, in FIG. 14 the dispenser and holder 106 comprises a brace 108 having vertical downward distending members 110, the ends of which extend horizontally to form hook-wickets 112 and 114. As is apparent from FIG. 14, hook-wickets 112 and 114 lie in a plane below the plane containing the wicket legs 116 and 118 of curved segments 120 and 122, respectively. Consequently, this type of bag dispenser and holder 106 would be used to accommodate bags having hook-wicket hole disposed below and intermediate a pair of spaced-apart wicket leg holes. FIG. 15 shows a similar type of bag dispenser and holder 124 as the bag dispenser and holder 106 of FIG. 14 except that the brace 126 is horizontally oriented and has as its ends upwarding distending members 128 and 130 from which extend horizontal support members 132 and 134, respectively. This type of bag dispenser and holder would accommodate the same type of bags for use with the bag dispenser and holder shown in FIG. 14.

FIG. 16 shows a bag dispenser and holder 136 comprising spring type members 138 and 140 disposed between brace member 142 and support members 144 and 146, respectively. The spring type members 138 and 140 will provide the support members 144 and 146 with sufficient flexibility so as to facilitate the deforming of these support members 144 and 146 to accommodate the advancement of a bag onto said support members 144 and 146. In addition, the spring members will provide a resilient or mechanical biasing force for the support members thus imparting to the support members the necessary resiliency needed to maintain a bag in an open position.

Figure 20:
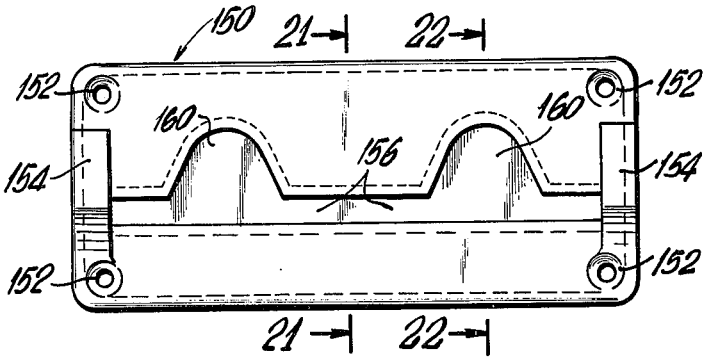
FIG. 20 is a front elevational view of a hinge and lock means for use with the bag dispenser and holder of this invention.
Figure 21:
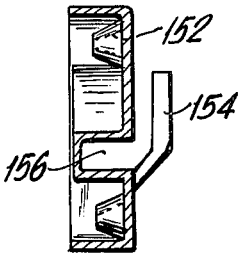
FIG. 21 is a cross sectional view taken along lines 21—21 of FIG. 20.
Figure 22:
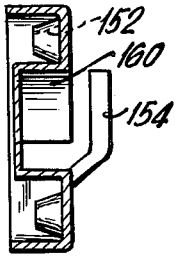
FIG. 22 is a cross sectional view taken along lines 22—22 of FIG. 20.
Figure 23:
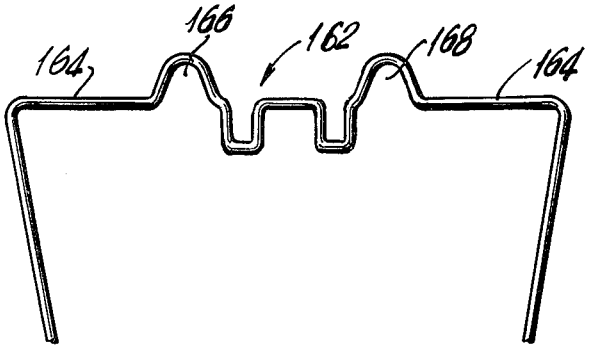
FIG. 23 is a plan view of a bag dispenser and holder for use with the hinge and lock means of FIG. 20.

To secure the bag dispenser and holder to a wall or other support, a hinge and lock member 150 as shown in FIG. 20 could be suitably attached to a surface via holes 152 using conventional screws (not shown). The hinge and lock member 150 has two spaced-apart U-shaped hooks 154 and a longitudinal groove 156. The groove 156 extends completely across hinge and lock member 150 as shown in FIG. 21 which is a view taken through line 21—21 of FIG. 20. Midway between the vertical center line and each edge of member 150, the groove would extend upward into a semi-circular configuration 160 as shown in FIG. 22 which is a view taken through line 22—22 of FIG. 20. FIG. 23 shows a bag dispenser and holder 162 having a brace member 164 designed with two rearwardly spaced-apart, semi-circular protrusions 166 and 168 adapted to fit within grooves 160 in hinge and lock member 150. In operation, the bag dispenser 162 would be vertically oriented and positioned on hooks 154 with protrusions 166 and 168 aligned with grooves 160. The bag dispenser and holder 162 would be rotated to a horizontal position and shifted to either the left or right thereby securing the protrusions 166 and 168 within the narrow portion of groove 156 and thus securing the bag dispenser and holder 162 in a horizontal plane for use. The bag dispenser and holder 162 can be removed by simply aligning protrusions 166 and 168 with grooves 160 and then rotating it to a vertical position. The bag dispenser and holder 162 could then easily be removed from hooks 154.

Figure 24:
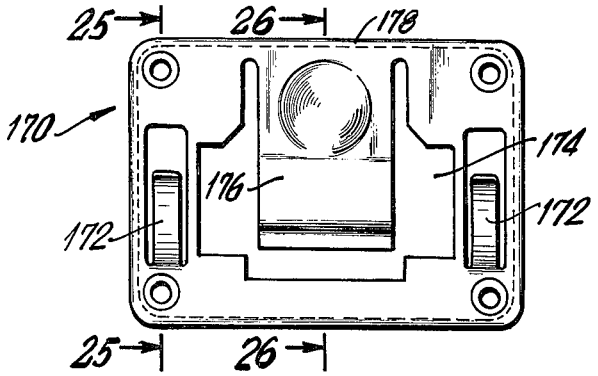
FIG. 24 is a front elevational view of a hinge and lock means for use with the bag dispenser and holder of this invention.
Figure 25:
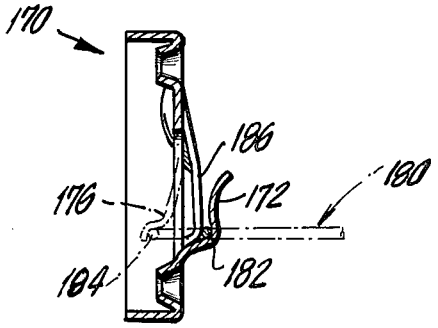
FIG. 25 is a cross sectional view taken along lines 25—25 of FIG. 24.
Figure 26:
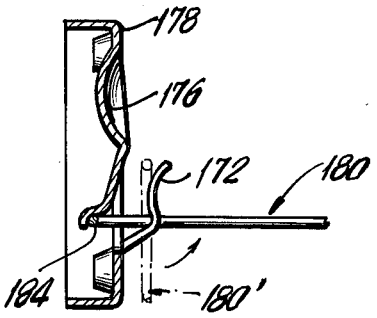
FIG. 26 is a cross sectional view taken along lines 26—26 of FIG. 24.
Figure 27:
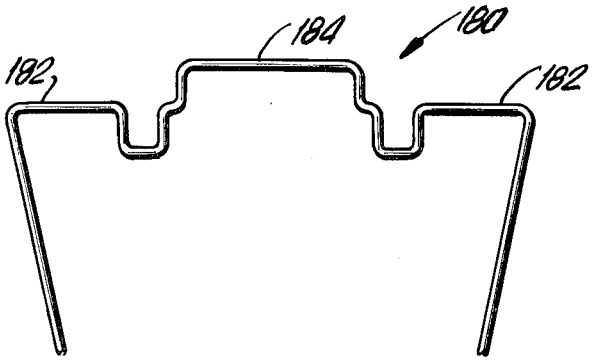
FIG. 27 is a plan view of a bag dispenser and holder for use with the hinge and lock means of FIG. 24.

FIG. 24 shows another embodiment of a hinge and lock member 170 having spaced-apart hooks 172. A center recess 174 is disposed in member 170 and a pivotal arm 176 attached to the upper wall 178 of member 170 is disposed over the recess 174. A bag dispenser and holder 180 for use with member 170 is shown in FIG. 27. Specifically, dispenser and holder 180 has a brace member 182 in which the center portion is extended rearwardly to form a rectangularly shaped protrusion 184. In operation, dispenser and holder 180 would be vertically held and placed onto hooks 172 whereupon it would be rotated to a horizontal position thereby being locked thereat by pivotal arm member 176 as shown in FIG. 26 which is a view taken through line 26—26 of FIG. 24 (including member 180) and held against wall 186 of member 170 as shown in FIG. 25 which is a view taken through line 25—25 of FIG. 24 (including member 180). To remove the dispenser and holder 180, member 176 is depressed thereby pivoting it inwardly, thus allowing dispenser and holder 180 to rotate to the vertical position as shown by broken lines 180′ in FIG. 26. Thereafter dispenser and holder 180 is removed from the hooks 172.

EXAMPLE

A $\frac{1}{8}$ inch diameter steel wire was formed into a bag dispenser and holder as basically shown in FIG. 3. A plurality of 2 $\frac{1}{2}$ mil-thick polyethylene bags, having an opened bag mouth perimeter of 26 inches (66 cm), was folded in a flat construction and given four wicket holes in each ply of the bag on 3 $\frac{1}{4}$-inche (8.3 cm) centers. The bag dispenser and holder had two center-spaced hook-wickets extended inwardly for a distance of 1.5 inches (3.8 cm) from the brace member and had two distending support members gradually arch inward from the ends of the brace member as shown in FIG. 3, said support members measuring 8.2 inches (20.9 cm) long. The lateral distance between the opposed ends of the support members measured 5 inches (12.2 cm). The bags were assembled onto the wicket support members and the hook-wickets and then using the techniques described in conjunction with FIGS. 5 to 7, the first and then each succeeding bag was dispensed from the wicket members, retained in a fully open position as shown in FIG. 7, and then removed from the dispenser as shown in FIG. 8. The bag dispenser and holder worked easily and no problems were encountered.

It should be understood that the foregoing disclosure relates to preferred embodiments of the invention and it is intended to cover all changes and modifications of the invention which do not depart from the spirit and scope of the appended claims. For example, a small portion of the back ply of the outermost disposed bag of a stack of bags could be adhesively secured to a corresponding samll portion of the front ply of the succeeding underlying bag which, in turn, could be adhesively secured in like manner to the next succeeding bag and so on in sequence. Thus when the outermost bag is being removed from the dispenser and holder, the back ply of the bag will automatically advance the front ply of the next succeeding bag along the curved segments thereby opening said succeeding bag. The initial bag upon being removed from the dispenser and holder could be easily separated from the succeeding bag. Another feature of using a stack of adhesively secured bags is that when a bag is advanced to the open position, its back ply will be secured to the front ply of the succeeding bag thereby enabling the bag to be in a more fully open position for utilization.

What is claimed is:

1. A bag dispenser and support holder comprising a brace member having a pair of deformable, resilient, outwardly extending spaced-apart support members, said support member comprising inner segments for supporting a plurality of bags proximal the brace member through a pair of spaced-apart holes in the mouth of the bags, and curved opposed outer segments which are aligned in a common plane to define a substantial, open hoop-type configuration; said brace member having at least one outwardly extending hook-wicket intermediate said extending pair of support members adapted for further supporting the plurality of bags through holes in said bags intermediate the pair of spaced-apart holes; and said support members being operable such that when a bag is advanced from the inner segments it will apply a sufficient force to slightly collapse the curved segments so as to accommodate the spacings of the support holes in the mouth of the bag and once the bag is fully advanced on the curved segments and supported on the at least one hook-wicket, said curved segments will exert an outwardly applied tensive force on the mouth of the bag sufficient to maintain the mouth of the bag in an open position.

2. The bag dispenser and support holder of claim 1 wherein said brace member has at least two hook-wickets intermediate said distending pair of support members.

3. The bag dispenser of claim 1 wherein the inner segments of the support members are substantially straight and parallel.

4. The bag dispenser and support holder of claim 3 wherein the opposed ends of the deformable, resilient support members extend outwardly and are substantially parallel to the inner segments of the support members so as to facilitate the loading and removal of bags onto and off of, respectively, the bag dispenser and support holder.

5. The bag dispenser and support holder of claim 1 wherein springs means are disposed between the brace member and the outwardly distending support members.

6. The bag dispenser and support holder of claim 1 wherein the at least one hook-wicket is disposed in a plane below the plane containing the outwardly distending support members.

7. The bag dispenser and support holder of claim 1 wherein a plurality of bags, each having a pair of wicket support holes and at least one hook-wicket hole in its upper portion, is supported on the support members and the at least one hook-wicket through said holes.

8. The bag dispenser and support holder of claim 7 wherein the curved segments of the support members will exert an outward tensive force on the mouth portion of a bag held and supported on said at least one hook-wicket and said curved segments.

9. The bag dispenser and support holder of claim 7 wherein said bags are flat bags.

10. The bag dispenser and support holder of claim 7 wherein said bags are gusset bags have a front ply, back ply and side gussets.

11. The bag dispenser and support holder of claim 10 wherein the support wicket holes in the bags are through the front ply, back ply and side gussets of the bags.

12. The bag dispenser and holder of claim 7 wherein said bag dispenser and holder is disposed substantially parallel with said bags; and said bags and bag dispenser and holder are disposed in a carton of suitable size to substantially envelop said bags and bag dispenser and holder.

13. The bag dispenser and holder of claim 7 wherein said bag dispenser and holder is disposed substantially parallel with the bags; said bags are disposed in a carton of suitable size to substantially envelop said bags; and said bag dispenser and holder is disposed outside of and substantially parallel to the surface of said carton.

14. The bag dispenser and holder of claim 1 wherein the brace member comprises a substantially horizontal segment which has at least one rearward protrusion extending therefrom; a securing plate adapted for being secured to a support member and having spaced-apart hooks and a groove therein; and said rearward brace protrusion being adapted for seating and locking within the groove in said securing plate and said horizontal segment being adapted for seating and resting within the hooks on said securing plate.

* * * * *